United States Patent [19]

Monreal

[11] Patent Number: 4,629,434

[45] Date of Patent: Dec. 16, 1986

[54] WATER GLIDING BOARD

[76] Inventor: F. Javier Monreal, 4242 Barker Hill Rd., Jamesville, N.Y. 13078

[21] Appl. No.: 672,813

[22] Filed: Nov. 19, 1984

[51] Int. Cl.[4] ..... A63C 15/00

[52] U.S. Cl. ..... 441/65; 441/72; 114/363

[58] Field of Search ..... 441/65, 72, 74, 67; 114/363

[56] References Cited

U.S. PATENT DOCUMENTS

| | | | |
|---|---|---|---|
| 4,106,143 | 8/1978 | Lucas | 114/363 |
| 4,353,573 | 10/1982 | Morgan | 441/65 |
| 4,357,894 | 11/1982 | Kirk | 114/363 |
| 4,466,373 | 8/1984 | Prade et al. | 441/74 |
| 4,503,799 | 3/1985 | Masters | 114/363 |

*Primary Examiner*—Galen Barefoot
*Assistant Examiner*—Thomas J. Brahan

[57] ABSTRACT

This device consists of a water gliding board, similar in size, materials and configuration, to the existing (in 1984) "Knee Boards" but substantially improved with a deletion of the securing strap and with the addition of low knee shells, high knee-and-buttocks shells, toe/foot straps, toe slots and heel wells, for the purpose of providing more mobility and thus more fun to the sport of water gliding (currently limited to "knee-boarding") with the substantial improvement in verstility by allowing different positions in one board, positions that consist of low kneeling, high kneeling, sitting and standing.

5 Claims, 3 Drawing Figures

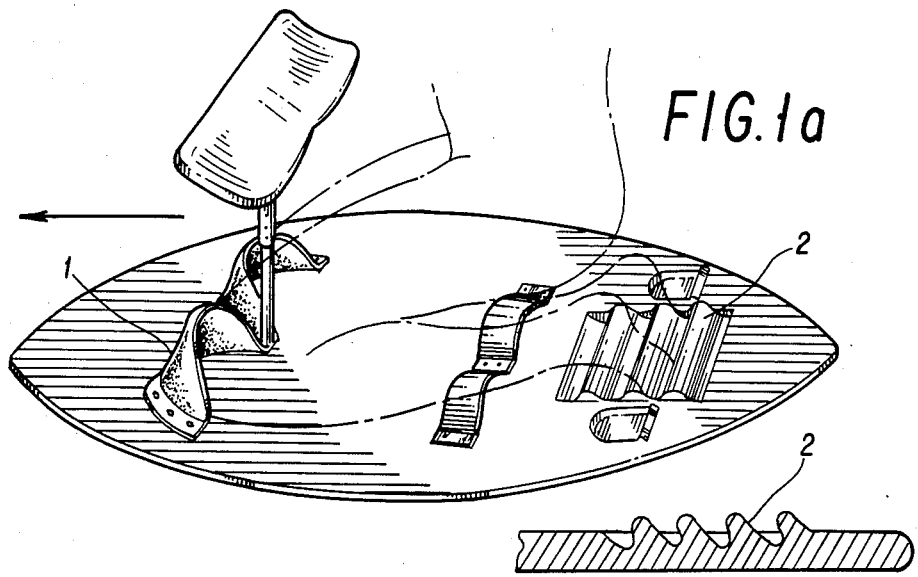
FIG. 1a
FIG. 1b
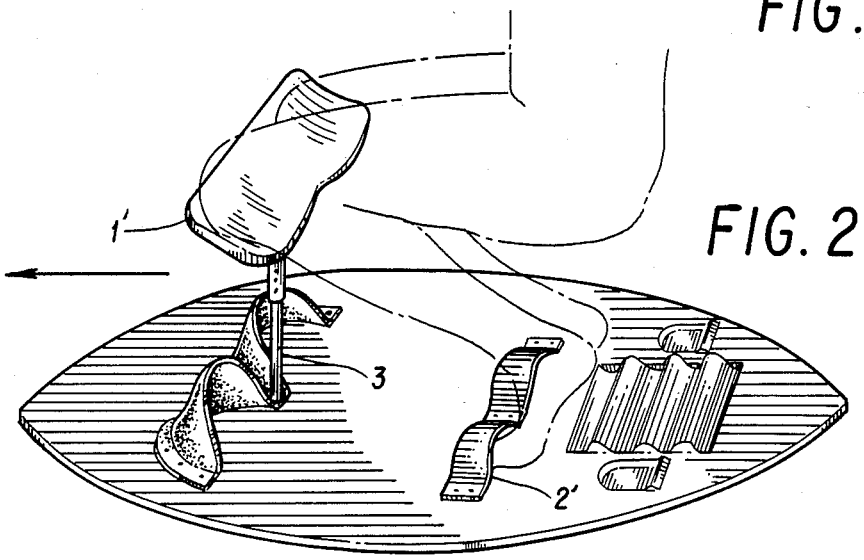
FIG. 2
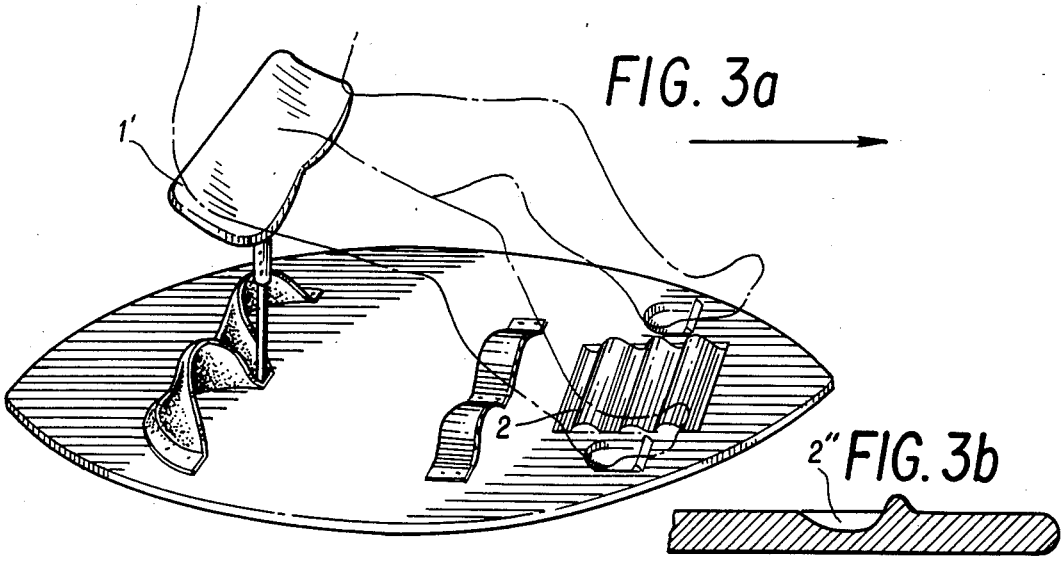
FIG. 3a
FIG. 3b

WATER GLIDING BOARD

BACKGROUND AND PURPOSE

Water surfing, skiing and gliding are all relatively new sports that are rapidly gaining widespread popularity. Kneeling on a water-gliding board while towed by a motor boat is the newest of these sports. The initial "knee-boards" were used with the person kneeling on the board but without any attachments or straps to the board. The person had to kneel towards the back of the board that thus would have most of its weight in the back and would glide in the water much like a regular water ski: i.e. it would glide with a significant tilt, its front tip off the water and its rear tip below the water surface. Such boards would offer much water resistance and would strain the person's low back muscles, limiting the fun and the endurance due to the low back pain they would cause.

Improvements in design and in the position of the kneeling person consisted of providing the Kneeling Board with a fastening strap that goes over the person's thigh while he/she kneel squated on their heels. At the same time the person's kneeling area was moved forward to avoid much of the tilt thus making the pulled ride over the water a true glide with the board almost horizontal. This eliminated much water resistance and strain on the back muscles and has increased the fun of the sport which in the past few years has been finally making a break-through in popularity. Other improvements have affected the shape and flotation qualities of the Kneeling Board.

Our present invention attempts to improve the Knee-Boarding sport on a gliding Knee Board by suggesting a better kneeling position and by offering the Board a higher versatility: i.e. it attempts to create a Board not only good for kneeling while towed by a motor boat but also good for standing and for sitting on it.

DESCRIPTION

This improved device consists of a water gliding board shaped and built within the general understanding of the presently existing (in 1984) "Knee Boards" that used in the sport of gliding on the water surface in the kneeling position while towed by a power boat. This invention does not attempt to improve the general shape or size or thickness or flotation qualities of the board itself, but only its means of offering the user a better and more versatile area to rest on, not restricting it to just kneeling, but also allowing sitting and standing.

The elimination of the currently used thigh straps in this invention is feasable due to the different elements and attachments that are described herein. All these elements secure the person to the gliding board in the different positions depicted in the three FIGURES (plus the standing position, that is not illustrated).

The improved gliding board may be constructed, as it already exists in the market, of light weight foam bonded to a polyethylene shell, but the material may vary and it is not claimed herein. Its dimensions (Approximately oval, and pointed in the back or on both ends), as for thickness, width and length, are not claimed either and may vary. Available sizes may measure, from front to back, anywhere between two and three times the length of the user's tibia bone.

For the lower kneeling position (FIGS. 1*a*–1*b*), the board is provided with a pair of variably soft and elastic "shells" 1 that are aimed at hugging the knees in the kneeling position and thus prevent a forward or a lateral separation of the knees from the board. The size, material, and attachment of such knee shells (or knee bindings) may be those currently used in water skis (i.e. a rubberized sheeting shaped to the bent knee(s) with both knees in a separate shell each or in a common wider shell that embraces both), but may vary and are not claimed herein. In this lower kneeling position, and to add a firm hold to the board without a strap, the person's toes anchor against a rear slot 2. Several such transverse slots are provided to allow for the different leg lengths. These slots may be variably wide, long and deep and may have a variably protruding lip behind each of them as depicted in FIG. 1*b* of the enlarged longitudinal section of the rear end of the board.

For the upper kneeling position (FIG. 2), the board is provided with a knee-resting area 1', wide enough for the two adult knees, variably contoured to them and inclined down towards the back to allow a lower leg-to-board angle of about 45°. This knee resting area may be made of firm, light weight plastic such as ¼" polypropylene sheeting contoured or concave enough to prevent lateral separation of the knees and at the same time, wide enough to allow sitting on it to face the opposite way. To provide additional hold of the knees, an additional flexible and variably elastic shell or cover, such as the one described for the "Lower Kneeling Position" (FIGS. 1*a*–1*b*) may be attached to the front and lateral edges of the "Upper Resting Area". This upper knee resting area (as a church "lectern" or music stand, is secured to the gliding board by a vertical, adjustable telescopic rod 3 so the user can adjust the height of the knee stand to his/her confort and leg size. The type of rod, however, its material, push-button locking device and fasteners to the board and to the knee stand may vary and are not claimed herein. For added hold to the board in this high kneeling position, the board is also provided with a pair of short elastic straps 2', destined to hold the person's toes in secure position to prevent a forward separation of the person from the board. The points of attachment of such straps or binders can be moved to allow for the different leg lengths, but the actual material of the straps or the type of fasteners used to hold them to the board may vary and are not claimed herein.

For the sitting position (FIGS. 3*a*–3*b*), the person sits on the described upper knee resting area 1' facing the opposite way of kneeling. To add extra hold to the board, the person rests his/her feet on the provided heel rests 2''. A section, longitudinally, is depicted in FIG. 3*b*, of such heel rests 2'' which may consist simply of an attached lump of plastic, or an actual protrusion of the board itself, with or without a corresponding carved, holloed area in the board, immediately behind such protrusion, to fit the person's heel(s).

For the standing position it is immediately apparent that the person water gliding on this improved board can easily erect him/herself from the kneeling position(s) or from sitting, while inserting one or both feet (facing either direction) in the middle straps 2'.

For easier "mounting", starting to glide while afloat, or for repositioning, this board is provided with 3 (three) towing hooks that are placed, respectively, at each end and on the upper knee resting area supporting rod. Such hooks are not illustrated in the figures, but can vary in size, shape and degree they encircle the towing rope though such rope should easily hook and unhook while gliding.

FIGURE EXPLANATIONS

All three figures included herein consist of the same improved water gliding board with all the deviced attachments showing in each of the figures. Each one, however, illustrates the purposes and uses of the board and of the attachments that are intended, for versatility, for different positions of the person riding or gliding on it.

FIGS. 1*a* AND 1*b*

These figure drawings depict the improved water gliding board with the person (broken lines) in a *low kneeling position.* FIG. 1*a* corresponds to using the knee shells or bindings described earlier. The upper kneeling area supporting rod explained in FIG. 2 is attached to the board between the two knee shells. FIG. 1*b* shows the toe rests slots as they appear in the board and enlarged in a longitudinal section.

FIG. 2

This figure drawing depicts the improved water gliding board with the person (broken lines) in a *high kneeling position* (intended to improve the person's posture and decrease the lumbar strain while giving more postural mobility without being locked by a fastening strap). FIG. 2 corresponds to the upper kneeling area described earlier, area or knee-rest that is connected to the board by an adjustable, telescopic, supporting rod. FIG. 2 shows using a pair of short and narrow (1" to 2") straps to secure the toes in position when gliding in the upper kneeling position *or when standing* on the board facing either direction.

FIGS. 3*a* AND 3*b*

These figure drawings depict the improved water gliding board with the person (broken line) *in the sitting position.* In this position, the person faces the opposite way from the described kneeling positions. FIG. 3*a* corresponds to the sitting area that doubles as upper kneeling area if the person faces the opposite way. FIG. 3*b* depicts the foot rests with the heel-well and protrusion lip as they appear in the board itself and also enlarged in longitudinal cross section.

What I now claim is:

1. A water gliding board capable of supporting a rider in several positions and of traveling in several directions comprising:

a pair of soft elastic knee shells attached along the upper surface of said board shaped to receive the knees of said rider when in a low kneeling position and traveling in a first direction;

a support means having an upper surface elevated above said upper surface of said board for supporting the knee of said rider when in a high kneeling position and traveling in said first direction, said upper surface of the support means further supports the buttocks of said rider when in a sitting position and traveling in a second direction opposite to said first direction;

a first foot receiving means for engaging the feet of said rider when in a standing position and traveling in either said first direction or said second direction, said first foot receiving means being located on said board to engage the feet of said rider also in the said high kneeling position traveling in the said first direction;

a second foot receiving means being located on the said board to engage the feet of said rider when in said low kneeling position; and a third foot receiving means being located on said board to engage the feet of said rider when in said sitting position.

2. A water gliding board according to claim 1 wherein the first foot receiving means comprises a pair of soft elastic straps attached to the upper surface of the said board at repositionable points.

3. A water gliding board according to claim 1 wherein the said second foot receiving means comprises a slot in the upper surface of the said board.

4. A water gliding board according to claim 1 wherein the said second foot receiving means further comprises a plurality of said slots.

5. A water gliding board according to claim 1 wherein the support means elevated above the said board for supporting the knees of the rider in the said high kneeling position and the buttocks of the rider in the said sitting position is mounted to the said board on a telescopic, length-adjustable rod.

* * * * *